US009877595B2

(12) United States Patent
Wang

(10) Patent No.: US 9,877,595 B2
(45) **Date of Patent: *Jan. 30, 2018**

(54) APPARATUS FOR A BABY CARRIER

(71) Applicant: Suling Wang, San Francisco, CA (US)

(72) Inventor: Suling Wang, San Francisco, CA (US)

( * ) Notice: Subject to any disclaimer, the term of this patent is extended or adjusted under 35 U.S.C. 154(b) by 97 days.

This patent is subject to a terminal disclaimer.

(21) Appl. No.: 13/848,034

(22) Filed: Mar. 20, 2013

(65) Prior Publication Data

US 2014/0284361 A1 Sep. 25, 2014

(51) Int. Cl.
*A47D 13/02* (2006.01)

(52) U.S. Cl.
CPC ..... *A47D 13/025* (2013.01)

(58) Field of Classification Search
CPC ... A41D 2400/482; A47D 13/025; A45F 3/08; B60N 2/2842; A61G 7/1023
USPC ..... 224/160, 159, 158, 161, 646, 647, 637; D3/214; 297/467, 219.12, 219.11
See application file for complete search history.

(56) References Cited

U.S. PATENT DOCUMENTS

| | | | | |
|---|---|---|---|---|
| 1,196,003 | A * | 8/1916 | Lippincott | 224/159 |
| 4,234,229 | A * | 11/1980 | Arnold | 297/467 |
| 4,271,998 | A | 6/1981 | Ruggiano | |
| 4,428,514 | A | 1/1984 | Elf | |
| 4,492,326 | A | 1/1985 | Storm | |
| 4,724,988 | A | 2/1988 | Tucker | |
| 4,778,091 | A | 10/1988 | Barto | |
| 5,205,450 | A | 4/1993 | Derosier | |
| 5,222,641 | A | 6/1993 | Medeiros, Jr. | |
| 5,509,590 | A | 4/1996 | Medeiros, Jr. | |
| 5,678,739 | A | 10/1997 | Darling | |
| 5,690,258 | A | 11/1997 | Kataoka | |
| 5,819,341 | A | 10/1998 | Simantob | |
| 5,987,665 | A | 11/1999 | Simantob | |
| 6,409,060 | B2 | 6/2002 | Donine | |
| 6,415,969 | B1 * | 7/2002 | Higuchi | 224/160 |
| 6,443,339 | B1 | 9/2002 | Higuchi | |
| 7,322,498 | B2 | 1/2008 | Frost | |
| 9,545,159 | B2 * | 1/2017 | Wang | A47D 13/025 |
| 2004/0155078 | A1 * | 8/2004 | Hwang | 224/160 |
| 2007/0138218 | A1 | 6/2007 | Calilung | |
| 2007/0278264 | A1 | 12/2007 | Chesal | |
| 2007/0284403 | A1 | 12/2007 | Minami | |
| 2009/0101683 | A1 * | 4/2009 | Gilboa et al. | 224/160 |
| 2011/0290831 | A1 * | 12/2011 | Wang | 224/160 |

* cited by examiner

*Primary Examiner* — Nathan J Newhouse
*Assistant Examiner* — Matthew Theis
(74) *Attorney, Agent, or Firm* — Jeffery D. Frazier

(57) ABSTRACT

An apparatus comprises a seat flap to support a baby's buttocks and thighs in a sling like fashion. The seat flap has a top edge, a bottom edge and side edges. A first means joins the top edge to an upper portion of a baby carrier with the seat flap being positioned on an interior portion of the baby carrier. The baby carrier is configured to carry the baby on the front or back of a caregiver's body with the baby facing outward or inward. The baby carrier is operable to support the baby in an upright position without the use of the seat flap. A second means joins the bottom edge to a lower portion of the baby carrier, wherein the baby sits upright and the baby's legs are supported at an angle of at least ninety degrees.

26 Claims, 12 Drawing Sheets

APPARATUS FOR A BABY CARRIER

CROSS-REFERENCE TO RELATED APPLICATIONS

The present continuation-in-part patent application claims priority benefit under 35 U.S.C. 120 of the U.S. nonprovisional patent application Ser. No. 12/789,301 entitled "An Apparatus for a Baby Carrier", filed on May 27, 2010, which further claims priority to U.S. provisional application for patent Ser. No. 61/614,447 entitled "An Apparatus for a Baby Carrier", filed on Mar. 22, 2013 under 35 U.S.C. 119(e). The contents of this/these related patent application (s) is/are incorporated herein by reference for all purposes to the extent that such subject matter is not inconsistent herewith or limiting hereof.

FEDERALLY SPONSORED RESEARCH OR DEVELOPMENT

Not applicable.

REFERENCE TO SEQUENCE LISTING, A TABLE, OR A COMPUTER LISTING APPENDIX

Not applicable.

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark Office, patent file or records, but otherwise reserves all copyright rights whatsoever.

FIELD OF THE INVENTION

The present invention relates generally to baby carriers. More particularly, the invention relates to a soft-structured baby carrier that enables the baby to be carried on the caregiver's body.

BACKGROUND OF THE INVENTION

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

Soft-structured and mei-tai style baby carriers usually consist of a flexible baby pouch that secures the baby in an upright position against the front or back of the caregiver's body by means of shoulder straps. There are many variations for how the baby pouch is sized, shaped and constructed. The baby pouch may be constructed as a simple flap of fabric or it may consist of several different components to support the back, front, buttocks or head of the baby. There are also many variations for how and where the shoulder straps connect to the baby pouch. Generally, the baby pouch has two shoulder straps that go over the caregiver's shoulders and either cross in back or loop around the shoulders and attach lower on the baby pouch similar to shoulder straps on a backpack. Soft-structured carriers generally use buckles as a means of attachment. In traditional Asian mei-tais the straps are usually secured by tying knots. Many, but not all, carriers of this type have a waistband that attaches to the bottom of the main body panel so much of the weight of the baby is distributed on the caregiver's hips rather than only on the shoulders for the comfort of the caregiver.

The majority of soft-structured carriers and mei-tais only allow the baby to face into the caregiver's body because allowing the baby to face outwards requires shaping the baby pouch so that the baby's legs can stick out the front by creating a narrow crotch region on the baby pouch. There is debate about whether it is healthy for a baby to be held in this way because, in the facing-out position, the baby's legs hang down and all his weight is concentrated on the narrow crotch region. Some experts believe that it is not healthy for the baby's spine and hip development to be held in this "crotch-dangling" position for long periods of time. Though many of the newer baby carriers that allow babies to face outward attempt to distribute the baby's weight along the baby's buttocks rather than only the baby's crotch, the baby's legs still hang down in a potentially harmful way as the baby's thighs are not supported in carriers with the baby pouch shaped this way and much of the baby's weight is still concentrated on a relatively small area on the baby's body which is potentially unhealthy and not as comfortable for the baby. It is therefore an objective of the present invention to provide a baby carrier that enables the baby to face outward while distributing the weight of the baby over a larger area of the baby's body.

The following is an example of a specific aspect in the prior art that, while expected to be helpful to further educate the reader as to additional aspects of the prior art, is not to be construed as limiting the present invention, or any embodiments thereof, to anything stated or implied therein or inferred thereupon. By way of educational background, another aspect of the prior art generally useful to be aware of is that in currently known carriers comprising a baby pouch with no narrow crotch region that only allow the baby to face into the caregiver's body, the baby's legs are usually at a 90-degree or greater angle because the thighs are supported and the baby's legs straddle the caregiver's body. This is considered by many to be a healthier position for the baby's hip and spine development. However, many babies prefer to face out and look at their surroundings and may resist being carried in the facing-in position for a long period of time.

The following is an example of a specific aspect in the prior art that, while expected to be helpful to further educate the reader as to additional aspects of the prior art, is not to be construed as limiting the present invention, or any embodiments thereof, to anything stated or implied therein or inferred thereupon. By way of educational background, another aspect of the prior art generally useful to be aware of is that one currently known baby carrier provides a flexible pouch with holes cut out for the baby's legs to stick through at the knees. By forming the pouch so the baby's knees are raised relative to the buttocks, the baby's thighs and buttocks are supported in the front facing-outwards position. However, this design does not easily adjust to accommodate babies of different sizes. The angle of the thigh support is not adjustable, possibly making it uncomfortable for babies that are either too small or too large for the pouch. In addition, if this carrier is not carefully structured with a very deep seat that perfectly fits the baby, the baby's legs may flop out of the pouch and hang down or to the side. Furthermore, in the facing-out position, the baby's torso may not be supported very well because the baby's thighs are by necessity bent up within the pouch in front of the abdomen creating a space between the pouch and the baby's torso.

The following is an example of a specific aspect in the prior art that, while expected to be helpful to further educate the reader as to additional aspects of the prior art, is not to be construed as limiting the present invention, or any embodiments thereof, to anything stated or implied therein or inferred thereupon. By way of educational background, another aspect of the prior art generally useful to be aware of is that another currently known design provides a baby carrier with a thick, rectangular, somewhat-rigid platform that holds up the thighs and buttocks of the baby and allows the baby to be seated while facing out. The seating platform is attached to the baby carrier in a hinge-like manner to create a platform or bench for the baby. However, the seating platform is bulky and does not enable the baby to be turned around to face into the caregiver's body since the platform is enclosed on the two sides with material. Furthermore, the rigid seating platform does not support the baby's torso so that the baby may shift and move around on the seat while being carried.

The following is an example of a specific aspect in the prior art that, while expected to be helpful to further educate the reader as to additional aspects of the prior art, is not to be construed as limiting the present invention, or any embodiments thereof, to anything stated or implied therein or inferred thereupon. By way of educational background, another aspect of the prior art generally useful to be aware of is that other currently known designs provide a rigid-framed baby carrier with a rigid seating platform that supports the baby's thighs in a position in which the baby faces out. However, the rigid-frame is bulky and not convenient for everyday casual use. Also, the rigid seating platform does not support the baby's torso so that the baby may shift and move around on the seat while being carried.

In view of the foregoing, there is a need for improved techniques for providing a baby carrier that enables the baby to be easily carried in multiple positions, including, but not limited to, facing out, while providing the support needed to the various parts of the baby's body.

BRIEF DESCRIPTION OF THE DRAWINGS

The present invention is illustrated by way of example, and not by way of limitation, in the figures of the accompanying drawings and in which like reference numerals refer to similar elements and in which:

FIG. 1A is a ¾ view of the baby carrier in a disassembled state. FIG. 1B is a diagrammatic front view of a main body of the baby carrier. FIG. 1C is a diagrammatic top view of the seat flap, and FIG. 1D is a diagrammatic bottom view of the seat flap;

FIG. 2A is a ¾ view of the baby carrier being worn by a caregiver with the baby in a front carry facing-out position. FIG. 2B is a ¾ view of the baby carrier being worn by the caregiver with the baby in a front carry facing-in position, and FIG. 2C is a ¾ view of the baby carrier being worn by the caregiver with the baby in a back carry position;

FIG. 9A is a ¾ view of the baby carrier being worn by a caregiver with the baby in a front carry facing-in position. FIG. 9B is a ¾ view of the baby carrier being worn by the caregiver with the baby in a front carry facing-out position;

FIG. 10B is a ¾ view of the baby carrier being worn by a caregiver with the baby in a front carry facing-in position. FIG. 10C is a ¾ view of the baby carrier being worn by the caregiver with the baby in a front carry facing-out position;

Figure 1A:
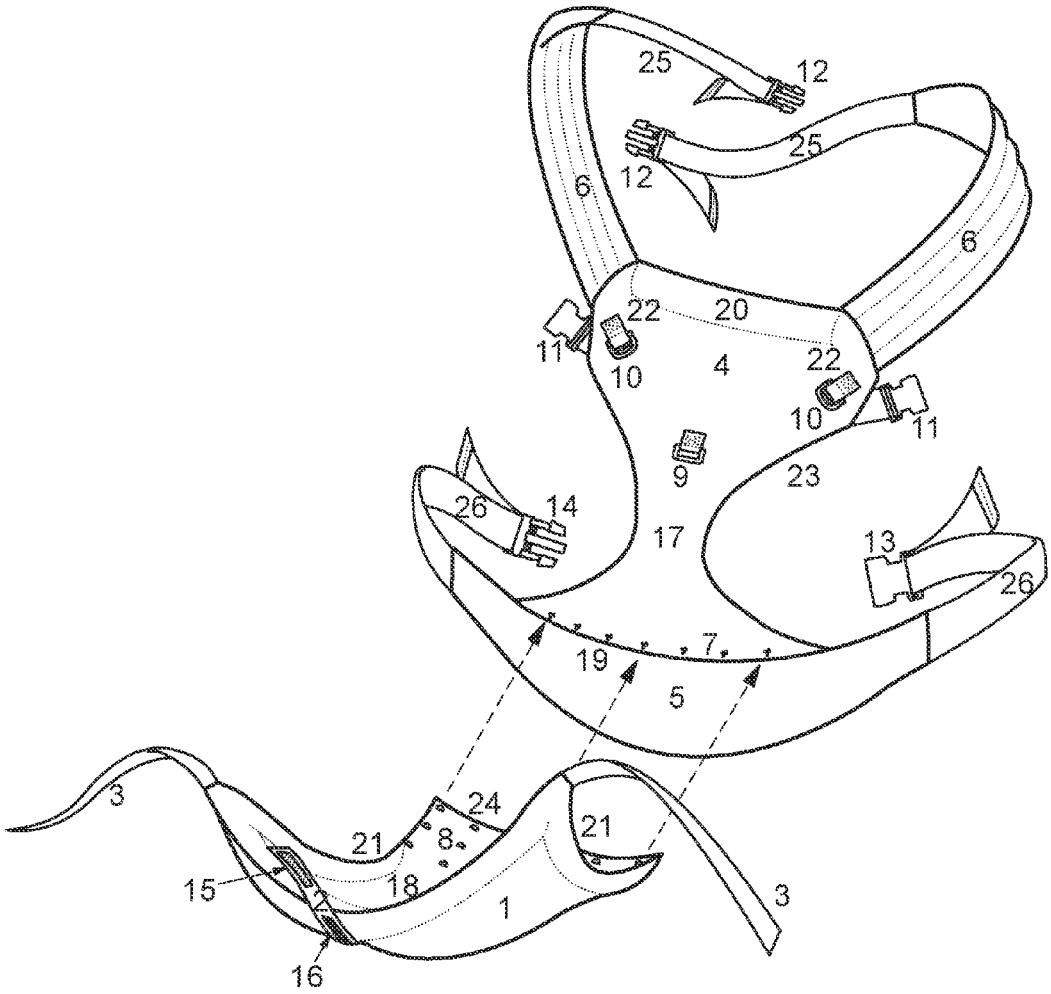
FIGS. 1A through 1D illustrate the anatomy of an exemplary baby carrier with a seat flap, in accordance with an embodiment of the present invention.

Unless otherwise indicated illustrations in the figures are not necessarily drawn to scale.

DETAILED DESCRIPTION OF THE PREFERRED EMBODIMENTS

The present invention is best understood by reference to the detailed figures and description set forth herein.

Embodiments of the invention are discussed below with reference to the Figures. However, those skilled in the art will readily appreciate that the detailed description given herein with respect to these figures is for explanatory purposes as the invention extends beyond these limited embodiments. For example, it should be appreciated that those skilled in the art will, in light of the teachings of the present invention, recognize a multiplicity of alternate and suitable approaches, depending upon the needs of the particular application, to implement the functionality of any given detail described herein, beyond the particular implementation choices in the following embodiments described and shown. That is, there are numerous modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

It is to be further understood that the present invention is not limited to the particular methodology, compounds, materials, manufacturing techniques, uses, and applications, described herein, as these may vary. It is also to be understood that the terminology used herein is used for the purpose of describing particular embodiments only, and is not intended to limit the scope of the present invention. It must be noted that as used herein and in the appended claims, the singular forms "a," "an," and "the" include the plural reference unless the context clearly dictates otherwise. Thus, for example, a reference to "an element" is a reference to one or more elements and includes equivalents thereof known to those skilled in the art. Similarly, for another example, a reference to "a step" or "a means" is a reference to one or more steps or means and may include sub-steps and subservient means. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

Unless defined otherwise, all technical and scientific terms used herein have the same meanings as commonly understood by one of ordinary skill in the art to which this invention belongs. Preferred methods, techniques, devices, and materials are described, although any methods, techniques, devices, or materials similar or equivalent to those described herein may be used in the practice or testing of the present invention. Structures described herein are to be understood also to refer to functional equivalents of such structures. The present invention will now be described in detail with reference to embodiments thereof as illustrated in the accompanying drawings.

From reading the present disclosure, other variations and modifications will be apparent to persons skilled in the art. Such variations and modifications may involve equivalent and other features which are already known in the art, and which may be used instead of or in addition to features already described herein.

Although Claims have been formulated in this Application to particular combinations of features, it should be understood that the scope of the disclosure of the present invention also includes any novel feature or any novel combination of features disclosed herein either explicitly or implicitly or any generalization thereof, whether or not it relates to the same invention as presently claimed in any Claim and whether or not it mitigates any or all of the same technical problems as does the present invention.

Features which are described in the context of separate embodiments may also be provided in combination in a single embodiment. Conversely, various features which are, for brevity, described in the context of a single embodiment, may also be provided separately or in any suitable subcombination. The Applicants hereby give notice that new Claims may be formulated to such features and/or combinations of such features during the prosecution of the present Application or of any further Application derived therefrom.

References to "one embodiment," "an embodiment," "example embodiment," "various embodiments," etc., may indicate that the embodiment(s) of the invention so described may include a particular feature, structure, or characteristic, but not every embodiment necessarily includes the particular feature, structure, or characteristic. Further, repeated use of the phrase "in one embodiment," or "in an exemplary embodiment," do not necessarily refer to the same embodiment, although they may.

Headings provided herein are for convenience and are not to be taken as limiting the disclosure in any way.

The enumerated listing of items does not imply that any or all of the items are mutually exclusive, unless expressly specified otherwise.

The terms "a", "an" and "the" mean "one or more", unless expressly specified otherwise.

As is well known to those skilled in the art many careful considerations and compromises typically must be made when designing for the optimal manufacture of a commercial implementation any system, and in particular, the embodiments of the present invention. A commercial implementation in accordance with the spirit and teachings of the present invention may configured according to the needs of the particular application, whereby any aspect(s), feature(s), function(s), result(s), component(s), approach(es), or step(s) of the teachings related to any described embodiment of the present invention may be suitably omitted, included, adapted, mixed and matched, or improved and/or optimized by those skilled in the art, using their average skills and known techniques, to achieve the desired implementation that addresses the needs of the particular application.

It is to be understood that any exact measurements/dimensions or particular construction materials indicated herein are solely provided as examples of suitable configurations and are not intended to be limiting in any way. Depending on the needs of the particular application, those skilled in the art will readily recognize, in light of the following teachings, a multiplicity of suitable alternative implementation details.

Many embodiments of the present invention and variations thereof provide a baby carrier in the style of a soft-structured carrier or traditional Asian mei-tai in which a baby may be carried on the back or front of the caregiver's body, facing inwards or outwards. The baby carrier itself in many embodiments may be constructed in many different ways providing it basically holds the baby in an upright position against the caregiver's body with straps that go over the caregiver's shoulders. Many embodiments comprise a seat flap that enables the baby's weight to be distributed evenly along the baby's thighs and buttocks to create a supportive seat for the baby in all carrying positions.

Figure 1B:
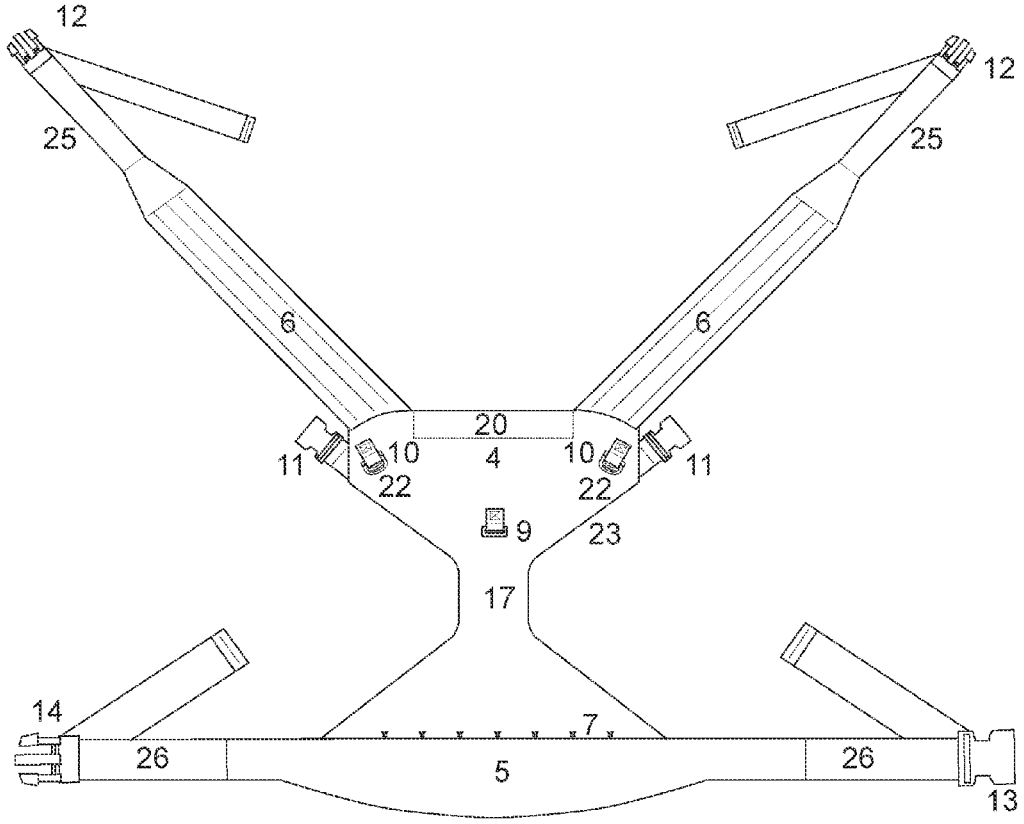
Figure 1C:
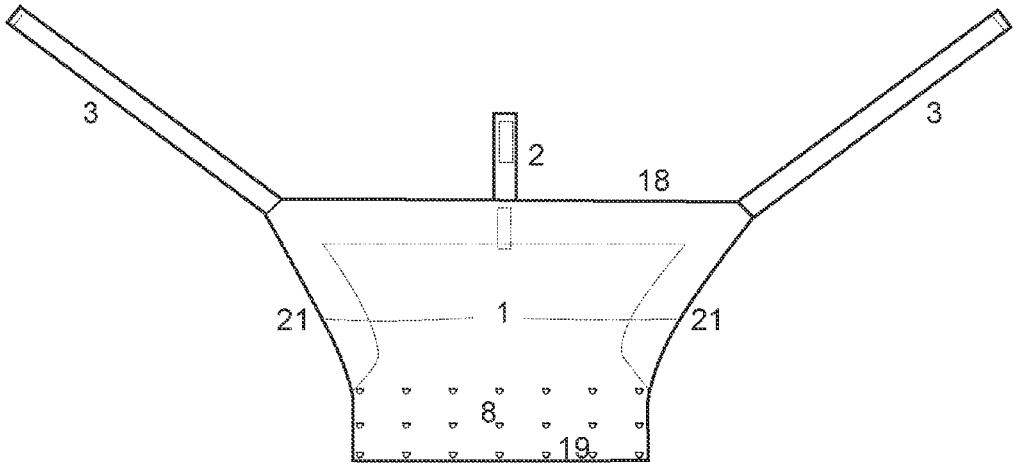
Figure 1D:
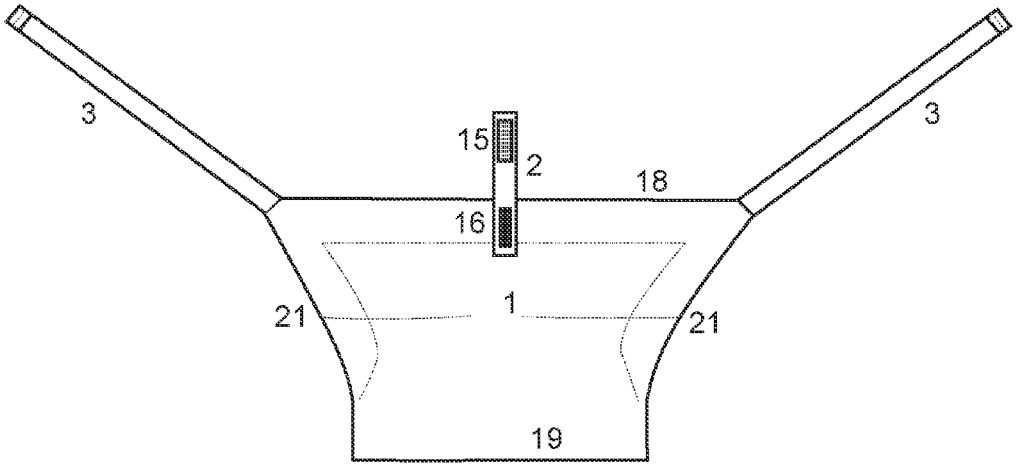

FIGS. 1A through 1D illustrate the anatomy of an exemplary baby carrier with a seat flap 1, in accordance with an embodiment of the present invention. FIG. 1A is a ¾ view of the baby carrier in a disassembled state. FIG. 1B is a diagrammatic front view of a main body 23 of the baby carrier. FIG. 1C is a diagrammatic top view of seat flap 1, and FIG. 1D is a diagrammatic bottom view of seat flap 1. In the present embodiment, the baby carrier comprises a baby pouch 4, which is a flap of fabric shaped to create a narrow crotch region 17 to allow the baby's legs to stick out the front of the carrier when in a facing-out position. A bottom edge 19 of baby pouch 4 attaches to a padded waistband 5 that is secured in back by connectors such as, but not limited to, adjustable side-release plastic buckles 13 and 14, which are attached to waistband 5 with extension straps 26. In alternate embodiments various different types of connectors made of various different materials may be used to secure the waistband such as, but not limited to, snaps, conventional buckles, clasps, slide buckles, etc. In the present embodiment, waistband 5 is adjustable in length to accommodate a wide range of body sizes for the caregiver. Shoulder straps 6 are attached to upper corners 22 of baby pouch 4. Shoulder straps 6 wrap over the caregiver's shoulders, cross in back and attach by connectors such as, but not limited to, side-release plastic buckles 11 and 12 to the region of baby pouch 4 close to the armpit areas on the opposite sides of the body. Buckles 11 and 12 attach to shoulder straps 6 with extension straps 25. In alternate embodiments the shoulder straps may attach with different types of connectors such as, but not limited to, snaps, conventional buckles, clasps, slide buckles, etc. and may be configured differently; for example, without limitation, the straps may not cross in back. In the present embodiment, shoulder straps 6 are preferably lightly padded for comfort but not bulky enough to interfere with crossing in the back; however in alternate embodiments the shoulder straps may not be padded. In the present embodiment, the lengths of shoulder straps 6 are adjustable to fit a wide range of body sizes. In some alternate embodiments, the two shoulder straps may be constructed as one piece that crosses in the back like a one piece harness rather than two separate straps.

Referring to FIG. 1A, main body 23 of the baby carrier is shown with seat flap 1 removed to illustrate and how seat flap 1 attaches to main body 23 of the carrier. The attachments that connect seat flap 1 to main body 23 are adjustable to accommodate a range of baby sizes. The present embodiment is preferably sized to fit babies from three months old to three years old. However, alternate embodiments may be implemented to fit a smaller range of babies. A bottom edge 24 of seat flap 1 is attached to main body 23 of the baby carrier with fasteners so that the height of the seat flap can be lengthened or shortened for smaller or bigger babies. In the present embodiment these fasteners are hook and eye closures. There are multiple rows of hooks 8 along the width of bottom edge 24 of seat flap 1 to accommodate different lengths of baby thighs, and where seat flap 1 meets bottom edge 19 of baby pouch 4 there is a row of eyes 7 to which hooks 8 attach. In alternate embodiments the seat flap may be attached to the main body of the baby carrier using various different means such as, but not limited to, snaps, hook and loop material, zippers, etc. In the present embodiment, straps 3 on a top edge 18 of seat flap 1 attach to main body 23 of the baby carrier with adjustable connectors such as, but not limited to, D-rings 10 that are attached near upper corners 22 of baby pouch 4. Other types of adjustable connectors that may be used to attach the straps of the seat flap to the main body of the carrier in alternate embodiments include, without limitation, snaps, buckles, hook and loop material, etc. In the present embodiment, a crotch strap 2 at the center of top edge 18 of seat flap 1 is preferably adjustable in length as well to accommodate babies of different sizes. Crotch strap 2 loops through a connector such as, but not limited to, a ring 9 that is attached to the front of baby pouch 1 and folds back to fasten seat flap 1 to ring 9 with an adjustable fastener such as, but not limited to, hook and loop fasteners 15 and 16. In alternate embodiments the crotch strap may fasten the seat flap to the baby pouch using various different means such as, but not limited to, snaps, buckles, clasps, etc. In the present embodiment, crotch strap 2 can be removed or its position can be adjusted to match the length of seat flap 1. It should be noted that the crotch strap is optional. It makes the seat flap work better and more secure, however, in many practical applications, technically, the seat flap could work without the crotch strap; for example, without limitation, if the baby cooperated and doesn't moves his legs too much.

Referring to FIGS. 1C and 1D, seat flap 1 is preferably shaped with sewn darts to create a bucket seat shape to better fit the shape of a baby's buttocks and thighs. However, the seat flap in alternate embodiments may be a flat piece of material. In the present embodiment, side edges 21 and top edge 18 of seat flap 1 are padded where they come in contact with the baby's thighs for the comfort of the baby. Referring to FIG. 1B, various parts of main body 23 of the carrier including, but not limited to, waistband 5, shoulder straps 6 and baby pouch 4 may be padded for the comfort of the baby or the caregiver. A top edge 20 of the baby pouch 4 may also be padded where it comes into contact with the baby's upper chest. Some embodiments may be implemented without padding, for example, without limitation, embodiments that are made of especially soft material. In the present embodiment, main body 23 and seat flap 1 are preferably made out of a soft but durable material such as, but not limited to, cotton twill, canvas, corduroy, or denim. Furthermore, all clasps and attachment mechanisms are preferably placed on the carrier so that the carrier is reversible, providing two different fabric options for the caregiver to wear. In order to reverse the carrier, the caregiver removes seat flap 1 and attaches it to the other side of main body 23. Alternate embodiments of the present invention may be implemented that are not reversible.

In the present embodiment, all straps and connectors are preferably detachable and adjustable to accommodate babies of different sizes. However, alternate embodiments may be implemented where some or all of the straps and connectors are not adjustable. For example, without limitation, the seat flap connectors do not necessarily need to be adjustable. In addition, some straps and connectors may not be detachable, for example, without limitation, the seat flap may be permanently attached to the main body of the baby carrier and still serve its function.

In the present embodiment, extension straps 25 and 26 may be made of various materials such as, but not limited to, webbing, fabric, leather, etc. In some embodiments, extension straps 25 and 26 may be integrated into main body 23 of the baby carrier or seat flap 1 as a continuous piece of fabric. Embodiments utilizing fabric straps may be more aesthetically pleasing; however these embodiments may be more difficult to adjust. In some embodiments, the carrier may comprise a hood or support of some kind for the baby's head that is secured by adjustable straps that change the length of the hood depending on how tall the baby is. In some embodiments comprising a hood or head support, this hood or head support may be detachable.

The present embodiment as illustrated by way of example in FIGS. 1A through 1D includes baby pouch 4, which is similar to many baby carriers on the market. As explained in the background section, the manner in which the baby pouches in currently known carriers are constructed and connect to the shoulder straps varies widely, with some carriers having more features and complex constructions. However, the present embodiment comprises seat flap 1, which may be adapted to almost any baby carrier of this type on the market regardless of how complexly or simply the carrier is constructed. For example, without limitation, embodiments of the present invention comprising seat flaps may be implemented for use with baby carriers with rigid frames, soft-structured baby carriers, wrap-style baby carriers, mei tais, onbuhimos, podaegis or other Asian-inspired baby carriers, etc.

Figure 2A:
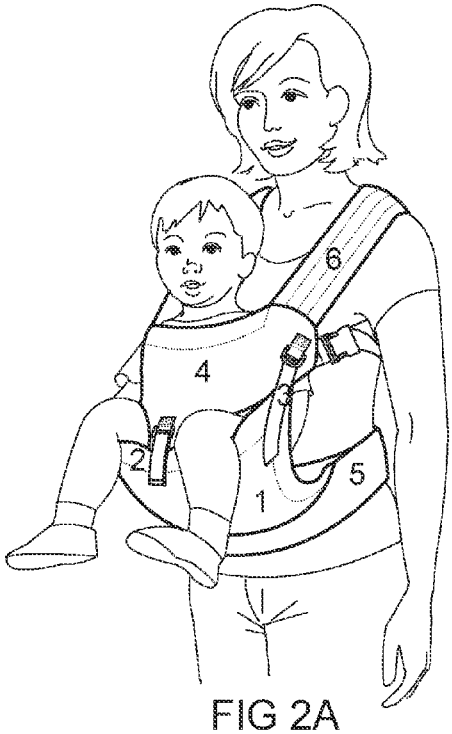
FIGS. 2A through 2C illustrate an exemplary baby carrier with a seat flap in use with a baby in multiple carrying positions, in accordance with an embodiment of the present invention.
Figure 2B:
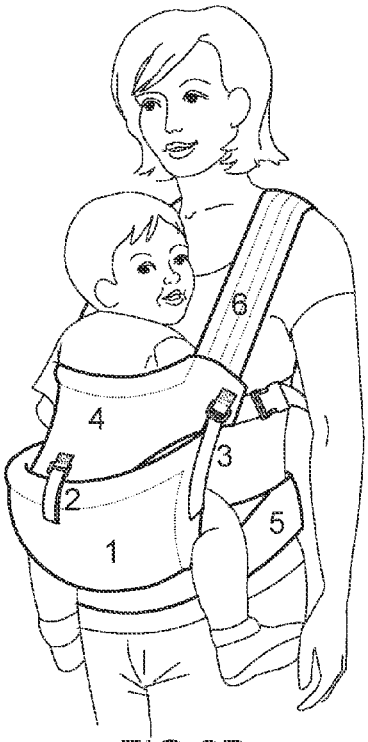
Figure 2C:
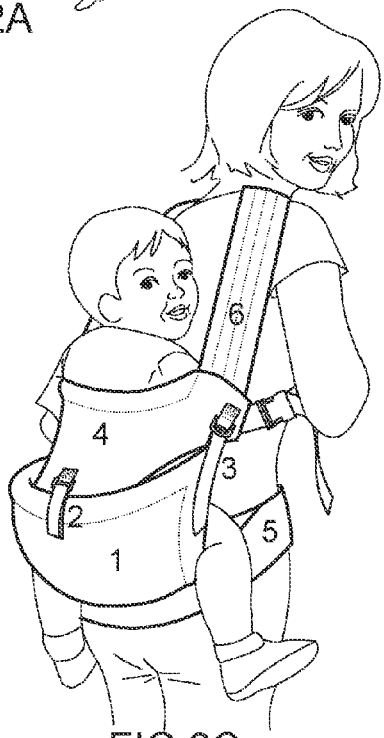

FIGS. 2A through 2C illustrate an exemplary baby carrier in use with a baby in multiple carrying positions, in accordance with an embodiment of the present invention. FIG. 2A is a ¾ view of the baby carrier being worn by a caregiver with the baby in a front carry facing-out position. FIG. 2B is a ¾ view of the baby carrier being worn by the caregiver with the baby in a front carry facing-in position, and FIG. 2C is a ¾ view of the baby carrier being worn by the caregiver with the baby in a back carry position. In the present embodiment, the baby carrier comprises a baby pouch 4 with shoulder straps 6 to secure the baby in an upright position to the front or back of the caregiver's body. The baby carrier also comprises a seat flap 1 that attaches to baby pouch 4 at or near the bottom edge of baby pouch 4, near where baby pouch 4 attaches to a waistband 5 or generally where the baby's buttocks are located if the baby is in the facing-out position. In typical use of the present embodiment, shoulder straps 6 go over the caregiver's shoulders and attach to baby pouch 4 near the armpits of the caregiver. Shoulder straps 6 may or may not cross in the back. Waistband 5 is wrapped around the waist of the caregiver and attached with fastening means on the caregiver's back. The baby may then be placed in baby pouch 4 in any of the positions illustrated by way of example in FIGS. 2A through 2C.

Referring to FIG. 2A, a top edge 18 of seat flap 1 has a strap 3 in each corner so that when the baby is in the facing-out position, pulling up on straps 3 causes seat flap 1 to cup under the baby's buttocks and top edge 18 of seat flap 1 to hook into the area behind the baby's knees. Straps 3 then attach to the main body of the baby carrier on the upper part of the carrier in the region close to the caregiver's armpits creating a seat or sling for the baby's thighs so that the baby's legs do not dangle down from the crotch and the baby's weight is distributed along the baby's thighs and buttocks rather than being concentrated at the crotch. In alternate embodiments, the point of attachment for the seat flap straps could be somewhere around the upper region of the carrier to maximize comfort for the caregiver. The position may have to be adjusted so that it attaches higher up on the carrier like on the shoulder straps or perhaps further back toward the armpits like on the straps where the shoulder straps loop under the caregiver's armpits. It should be appreciated that, in many practical applications, the point of attachment may not necessarily be on the baby pouch as described in the present embodiment. In the front carry facing-out position, the baby can face outwards while his thighs and buttocks are securely cradled and supported by seat flap 1 in a seated position conducive to healthy spine and hip development. Seat flap 1 acts as a sling for the baby's thighs and buttocks that is separate from baby pouch 4, which holds the baby's torso.

Referring to FIG. 2B, the baby is turned around and facing into the caregiver's body to illustrate how the baby's legs stick out side edges 21 of seat flap 1 and how the baby's buttocks and thighs are equally supported in the front carry facing-in position. In this position, the carrier functions similarly to most of the other carriers on the market of this style that do not allow babies to face out. The baby's legs are held at a 90-degree or greater angle because the thighs are supported and the baby's legs straddle the caregiver's body. Straps 3 on top edge 18 of seat flap 1 can be adjusted in length for better fit and support of the baby when switching between the facing-out and facing-in positions.

Referring to FIG. 2C, the baby is positioned on the back of the caregiver's body facing into the caregiver's body with the baby's legs sticking out side edges 21 of seat flap 1. The baby's buttocks and thighs are supported. The baby's legs are held at a 90-degree or greater angle because the thighs are supported and the baby's legs straddle the caregiver's body.

Figure 3:
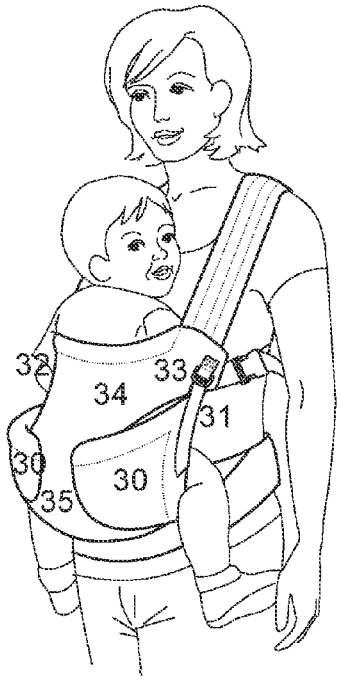
FIG. 3 is a ¾ view of an exemplary baby carrier comprising two separate seat flaps, in accordance with an embodiment of the present invention.

FIG. 3 is a ¾ view of an exemplary baby carrier comprising two separate seat flaps 30, in accordance with an embodiment of the present invention. In the present embodiment, seat flaps 30 are positioned under each thigh of the baby rather than one single seat flap across the width of the baby carrier as describe in the foregoing embodiment. Each separate seat flap 30 comprises a strap 31 on the upper edge corner that attaches to a main body 32 of the carrier near an upper corner 33 of a baby pouch 34. Each separate flap 30 in this embodiment is attached to baby pouch 34 at a crotch region 35 of baby pouch 34 eliminating the need for a crotch strap as described in the foregoing embodiment.

Figure 4:
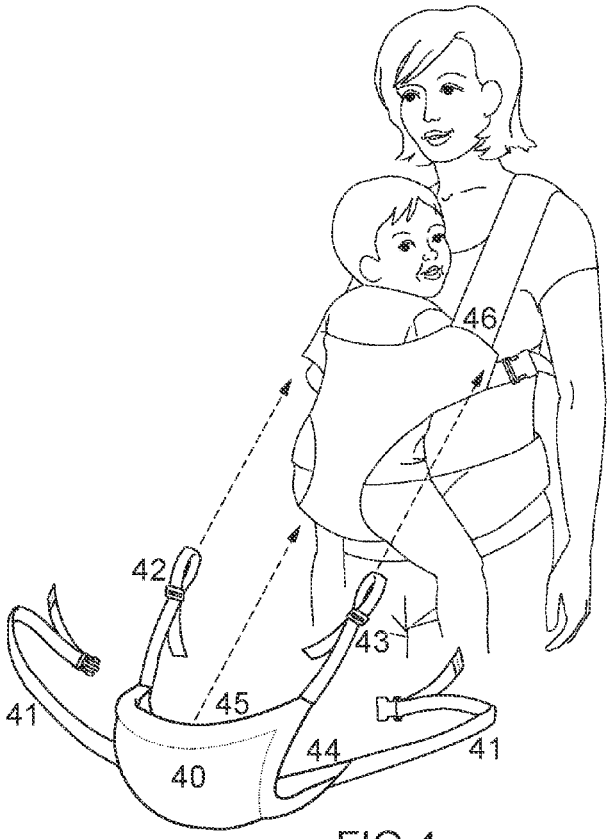
FIG. 4 is a ¾ view of an exemplary seat flap that may be used as an add-on accessory for existing baby carriers, in accordance with an embodiment of the present invention.

FIG. 4 is a ¾ view of an exemplary seat flap 40 that may be used as an add-on accessory for existing baby carriers, in accordance with an embodiment of the present invention. In the present embodiment, seat flap 40 comprises a waistband 41 attached at a bottom edge 44 to go around the caregiver's waist independent of the baby carrier being used. Seat flap 40 in this embodiment has straps 42 and 43 at the corners of an upper edge 45 that loop around a convenient point of attachment 46 on the baby carrier in use, creating a supportive seat for the baby's thighs and buttocks as described previously. The straps of seat flap 40 may attach to the existing baby carrier using means other than loops such as, but not limited to, snaps. Those skilled in the art, in light of the present teachings, will readily recognize that existing baby carriers may vary in construction and that embodiments of the present invention may be implemented to adapt to these variations in construction. For example, the baby pouch could be constructed so the pouch detaches at the upper corners from the shoulder strap with fasteners or straps. Or the baby pouch could have a high construction that extends high on the baby's body and includes armholes for the baby's arms to stick out. In these cases, the armholes or the extra fasteners or straps for attaching the baby pouch to the shoulder straps may be convenient attachment points for the seat flap straps 42 and 43.

Figure 5:
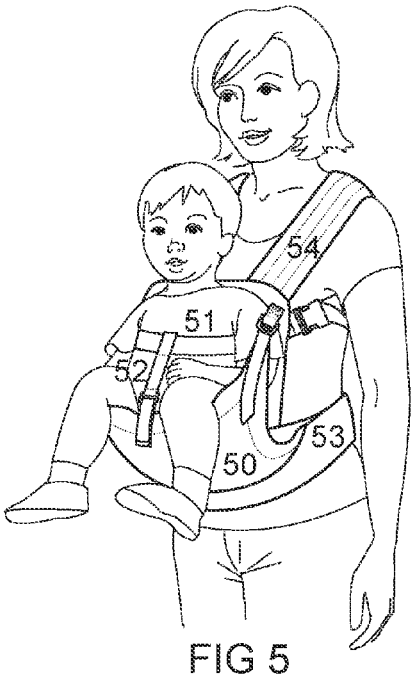
FIG. 5 is a ¾ view of an exemplary baby carrier comprising a seat flap that does not have a baby pouch, in accordance with an embodiment of the present invention.

FIG. 5 is a ¾ view of an exemplary baby carrier comprising a seat flap 50 that does not have a baby pouch, in accordance with an embodiment of the present invention. In the present embodiment, seat flap 50 provides almost all the support for the baby, attaching at the bottom or back to shoulder straps 54 and a waistband 53. Additional straps 51 that connect to a crotch strap 52 and shoulder straps 54 take the place of the support usually provided by a baby pouch.

Figure 6:
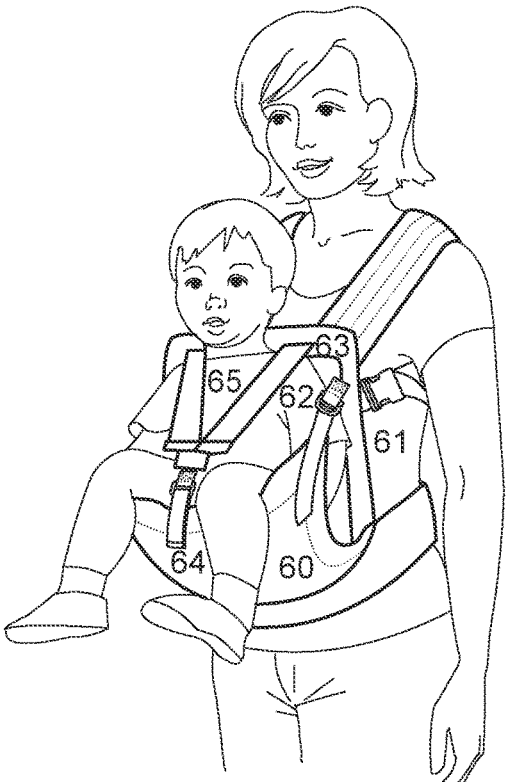
FIG. 6 is a ¾ view of an exemplary rigid frame baby carrier comprising a seat flap, in accordance with an embodiment of the present invention.

FIG. 6 is a ¾ view of an exemplary rigid frame baby carrier 61 comprising a seat flap 60, in accordance with an embodiment of the present invention. In the present embodiment, instead of a rigid framed seating platform as is typical with rigid frame baby carriers, baby carrier 61 comprises a flexible seat flap 60 that attaches with seat flap straps 62 to a backrest 63 of rigid frame baby carrier 61. The bottom edge of seat flap 60 is attached to rigid frame baby carrier 61 at the bottom of backrest 63. Seat flap 60 also comprises a crotch strap 64 that attaches to a shoulder harness 65 on rigid frame baby carrier 61. Those skilled in the art, in light of the present teachings, will readily recognize that existing rigid frame baby carriers may vary in construction and that embodiments of the present invention may be implemented to adapt to these variations in construction. For example the rigid frame baby carrier 61 could have a flexible baby pouch that secures the baby to the backrest 63 rather than the shoulder harness 65 illustrated in this embodiment. In this case the seat flap 60 could attach to points on the upper corners of the baby pouch similar to the way described in the preferred embodiment. As another example the backrest 63 could have side extensions that support the baby on the sides that the seat flap straps 62 could attach to.

Figure 7:
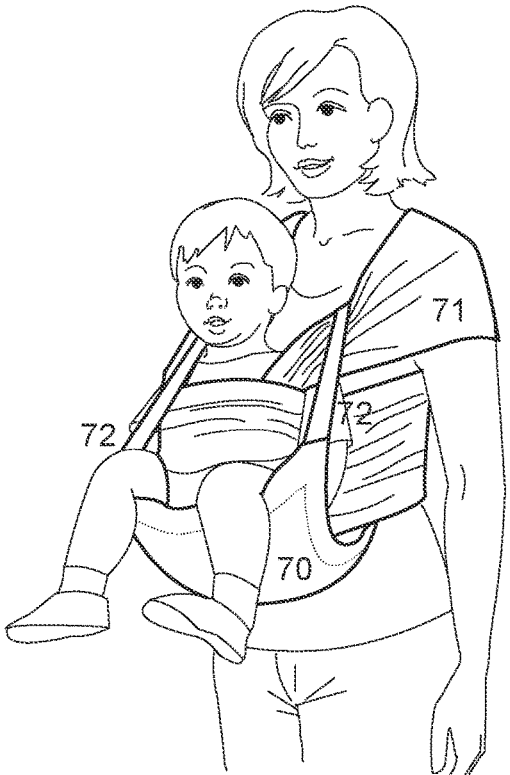
FIG. 7 is a ¾ view of an exemplary wrap style baby carrier with a seat flap in a front carry facing-out position, in accordance with an embodiment of the present invention.

FIG. 7 is a ¾ view of an exemplary wrap style baby carrier 71 with a seat flap 70 in a front carry facing-out position, in accordance with an embodiment of the present invention. Wrap-style baby carrier 71 is basically a long piece of fabric that wraps the baby securely to the caregiver's body in a variety of positions. In the front carry facing-out position, the baby's thighs are not typically supported well. However, as shown in the present embodiment, seat flap 70 may attach with seat flap straps 72 to the material of wrap style baby carrier 71 with fasteners such as, but not limited to, clips, hook and loop fasteners or snaps near the caregiver's armpits. The bottom edge of seat flap 70 may attach to the material behind the baby's buttocks with fasteners such as, but not limited to, clips, snaps, hook and loop fasteners, etc.

Figure 8:
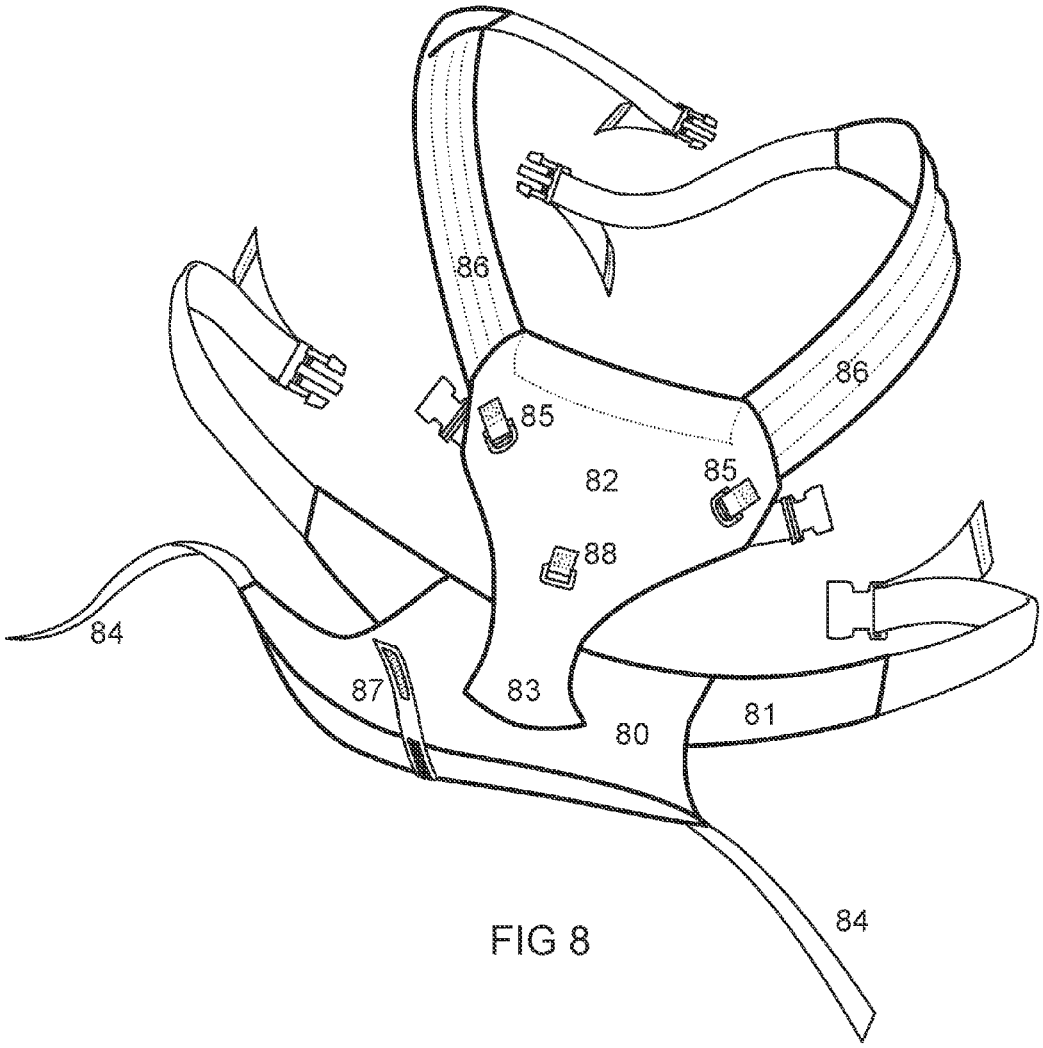
FIG. 8 is a ¾ view of an exemplary baby carrier comprising a seat flap attached to the baby pouch at the crotch, in accordance with an embodiment of the present invention.

FIG. 8 illustrates another alternate embodiment of the present invention directed to a soft-structured baby carrier with a seat flap comprising a seat flap 80 that fastens to the top edge of the waistband 81. The narrow crotch region 83 of the baby pouch 82 is attached to the center of the seat flap 80 either permanently or with adjustable connectors. Shoulder straps 86 connect to the top edge of the baby pouch 82. The seat flap straps 84 attach to the upper region 85 of the baby carrier. The seat flap 80 also comprises a crotch strap 87 that attaches to the center 88 of the baby pouch 82.

Figure 9A:
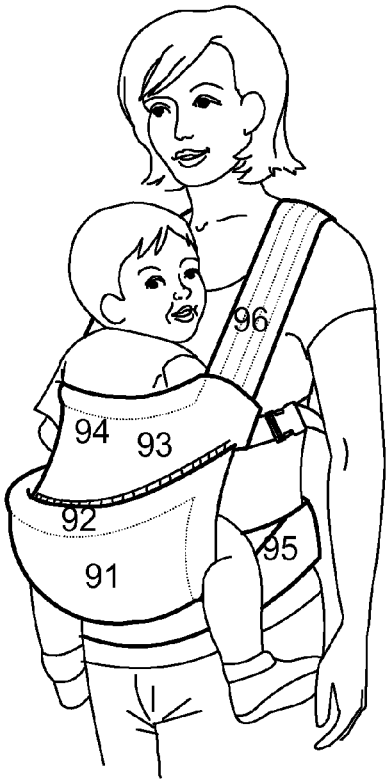
FIGS. 9A and 9B illustrate an exemplary baby carrier with a seat flap in use with a baby in multiple carrying positions, in accordance with an embodiment of the present invention.
Figure 9B:
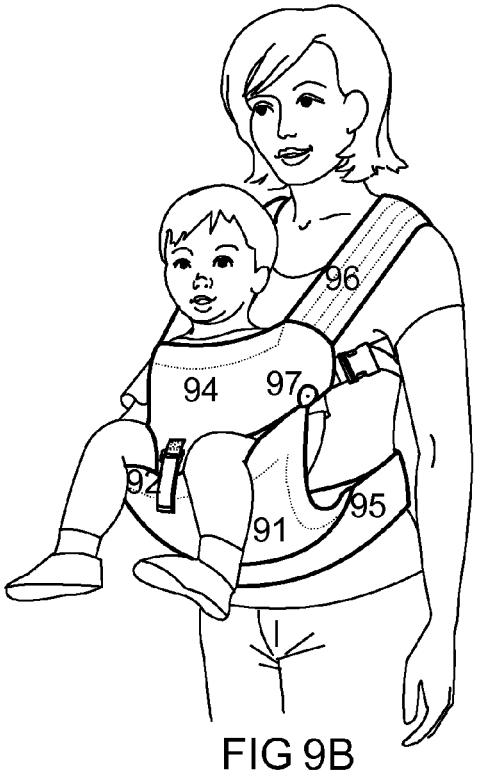

FIGS. 9A and 9B illustrate an exemplary baby carrier with a seat flap in use with a baby in multiple carrying positions, in accordance with an embodiment of the present invention. FIG. 9A is a ¾ view of the baby carrier being worn by a caregiver with the baby in a front carry facing-in position. FIG. 9B is a ¾ view of the baby carrier being worn by the caregiver with the baby in a front carry facing-out position.

FIG. 9A is a ¾ view of an exemplary baby carrier comprising a seat flap 91 that attaches to the upper part of the baby carrier along the length of the top edge 92 of the seat flap 91. In the present embodiment, the top edge 92 of the seat flap 91 attaches to the main body 94 of the baby carrier along the length of the top edge 92 with a zipper 93. In other embodiments, other suitable attachment means may be used. The baby faces into the caregiver's body when the top edge of the seat flap is attached to the upper portion of the baby carrier.

FIG. 9B is a ¾ view of an exemplary baby carrier comprising a seat flap 91 that is attached to the upper part of the main body 94 of the baby carrier at the corners of the top edge of the seat flap in accordance with an embodiment of the present invention. In the present embodiment, the corners of the top edge 97 of the seat flap 91 attach to the main body 94 of the baby carrier with buttons. In other embodiments, other suitable attachment means may be used.

Figure 10A:
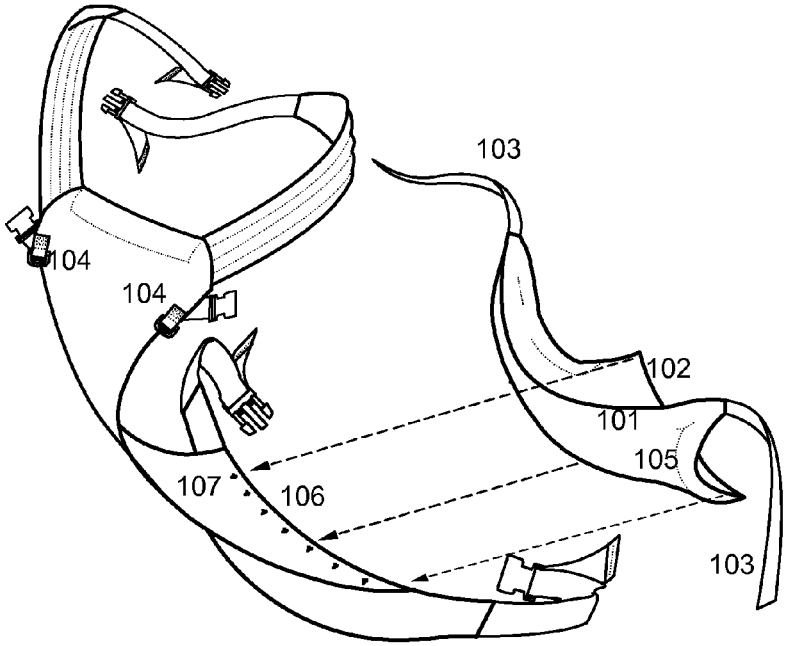
FIG. 10A is a ¾ view of an exemplary baby carrier comprising a seat flap that is positioned on the inner surface the baby carrier in accordance with an embodiment of the present invention.

FIG. 10A is a ¾ view of an exemplary baby carrier comprising a seat flap that is positioned on the inner surface the baby carrier in accordance with an embodiment of the present invention.

FIG. 10A is a ¾ view of an exemplary baby carrier comprising a seat flap 105 that is positioned on the inner surface 107 of the baby carrier in accordance with an embodiment of the present invention. In the present embodiment, the attachments that attach the bottom edge 106 of the seat flap to the main body of the baby carrier are on the inner surface 107 of the baby carrier so that the seat flap is positioned between the baby's body and the baby carrier. The corners of the baby carrier are attached to the upper region 104 of the baby carrier with seat flap straps 103. In other embodiments, other suitable attachment means may be used.

Figure 10B:
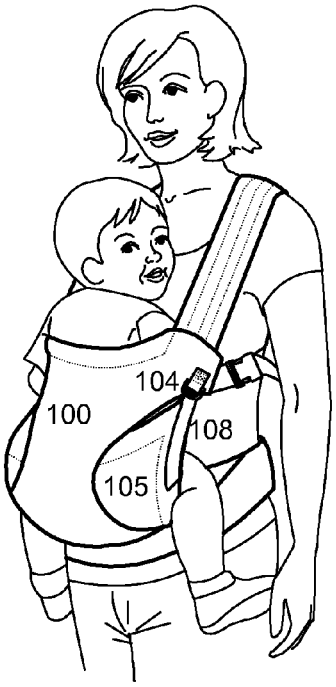
FIGS. 10B and 10C illustrate an exemplary baby carrier with a seat flap in use with a baby in multiple carrying positions, in accordance with an embodiment of the present invention.
Figure 10C:
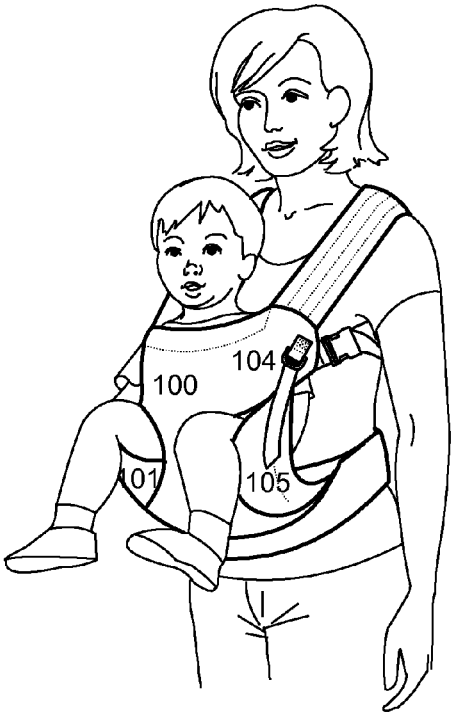

FIGS. 10B and 10C illustrate an exemplary baby carrier with a seat flap in use with a baby in multiple carrying positions, in accordance with an embodiment of the present invention. FIG. 10B is a ¾ view of the baby carrier being worn by a caregiver with the baby in a front carry facing-in position. FIG. 10C is a ¾ view of the baby carrier being worn by the caregiver with the baby in a front carry facing-out position.

FIG. 10B is a ¾ view of the exemplary baby carrier shown in FIG. 10A with the baby in the baby carrier facing into the caregiver's body to illustrate how the baby carrier works when the seat flap 105 is positioned on the inner surface of the baby carrier. In this position the baby's legs stick out the side edges 108 of the seat flap.

FIG. 10C is a ¾ view of the exemplary baby carrier shown in FIG. 2A with the baby in the baby carrier facing out from the caregiver's body to illustrate how the baby carrier works when the seat flap 105 is positioned on the inner surface of the baby carrier. In this position the baby's legs stick out the front 101 of the baby carrier through the openings between the baby carrier and the top edge of the seat flap seat flap.

Figure 11:
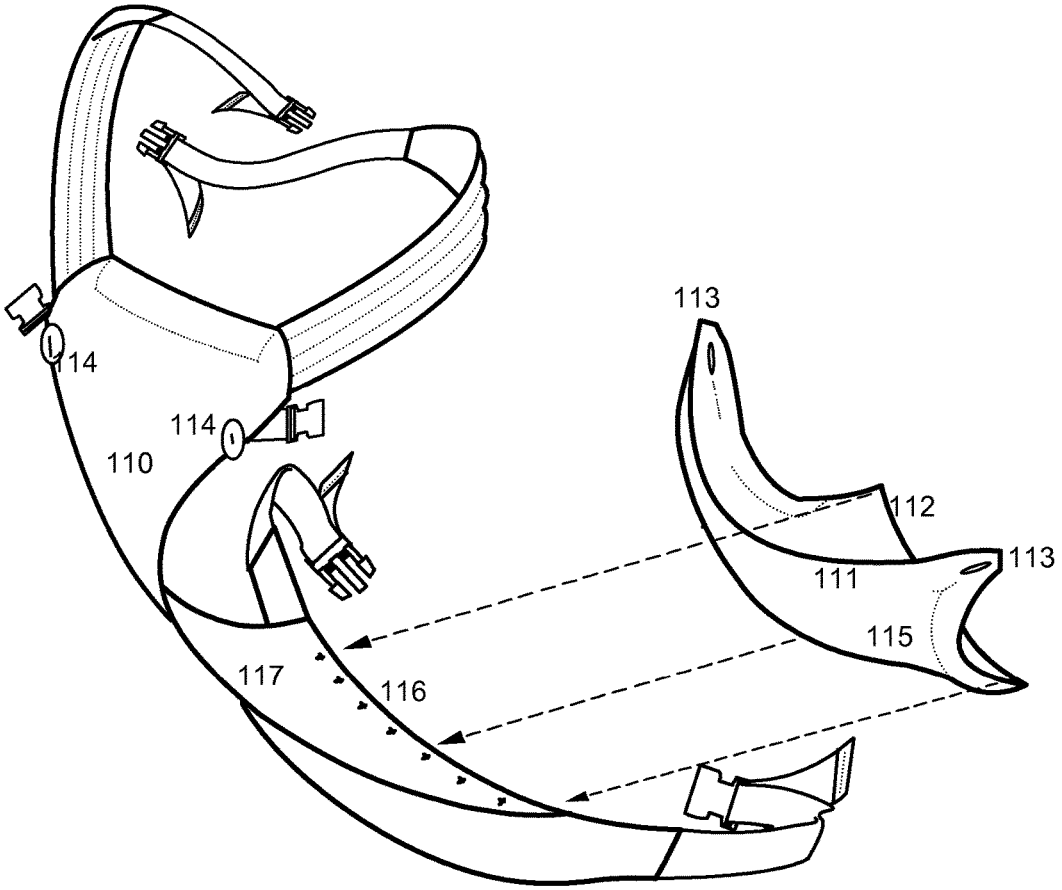
FIG. 11 is a ¾ view of an exemplary baby carrier comprising a seat flap that is positioned on the inner surface of the baby in accordance with an embodiment of the present invention.

FIG. 11 is a ¾ view of an exemplary baby carrier comprising a seat flap that is positioned on the inner surface of the baby in accordance with an embodiment of the present invention.

FIG. 11 is a ¾ view of an exemplary baby carrier comprising a seat flap 115 that is positioned on the inner surface 117 of the baby carrier 110 in accordance with an embodiment of the present invention. In the present embodiment, the attachments that attach the bottom edge 116 of the seat flap to the main body of the baby carrier are on the inner surface 117 of the baby carrier 110 so that the baby carrier is positioned between the baby's body and the baby carrier. The corners 113 of the baby carrier are attached to the upper region 114 of the baby carrier 110 with buttons. In other embodiments, other suitable attachment means may be used.

Figure 12:
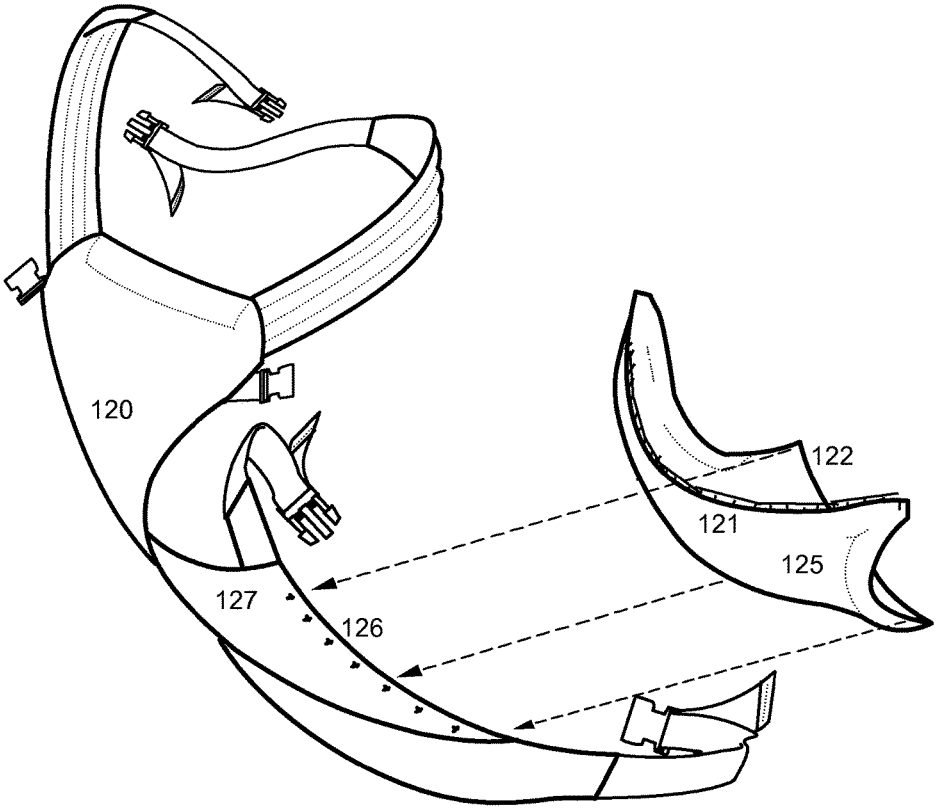
FIG. 12 is a ¾ view of an exemplary baby carrier comprising a seat flap that is positioned on the inner surface of the baby carrier in accordance with an embodiment of the present invention.

FIG. 12 is a ¾ view of an exemplary baby carrier comprising a seat flap that is positioned on the inner surface of the baby carrier in accordance with an embodiment of the present invention.

FIG. 12 is a ¾ view of an exemplary baby carrier comprising a seat flap 125 that is positioned on the inner surface 127 of the baby carrier 120 in accordance with an embodiment of the present invention. In the present embodiment, the attachments 126 that attach the bottom edge of the seat flap to the main body of the baby carrier are on the inner surface 127 of the baby carrier 120 so that the baby carrier is positioned between the baby's body and the baby carrier. The top edge 121 of the seat flap 125 is attached to the inner surface of the upper region of the baby carrier with a zipper. In other embodiments, other suitable attachment means may be used.

Figure 13A:
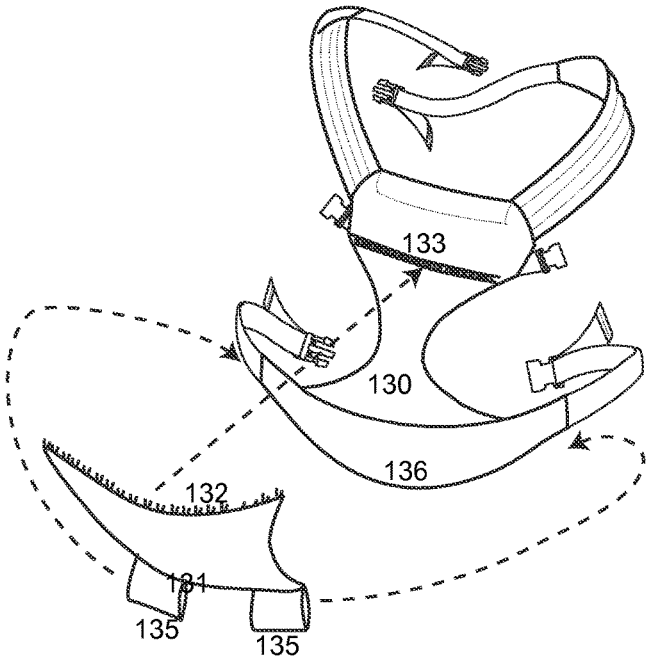
FIG. 13A is a ¾ view of an exemplary baby carrier comprising a seat flap that attaches to the upper part of the baby carrier along the length of the top edge of the seat flap in accordance with an embodiment of the present invention.

FIG. 13A is a ¾ view of an exemplary baby carrier comprising a seat flap that attaches to the upper part of the baby carrier along the length of the top edge of the seat flap in accordance with an embodiment of the present invention.

FIG. 13A is a ¾ view of an exemplary baby carrier 130 comprising a seat flap 131 that attaches to the upper part of the baby carrier along the length of the top edge 132 of the seat flap. In the present embodiment, the top edge 132 of the seat flap 131 attaches to the main body 134 of the baby carrier along the length of the top edge 132 with a zipper 133. In other embodiments, other suitable attachment means may be used. The bottom edge of the seat flap is attached to the baby carrier by sliding loops 135 onto the waistband 136 of the baby carrier. In other embodiments, other suitable attachment means may be used. The baby faces into the caregiver's body when the top edge of the seat flap is attached to the upper portion of the baby carrier.

Figure 13B:
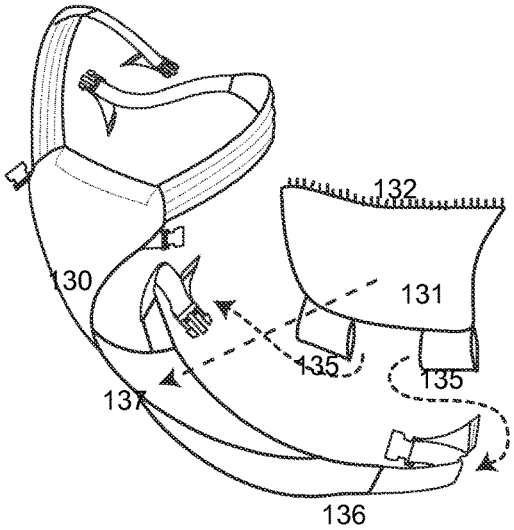
FIG. 13B is a ¾ view of an exemplary baby carrier comprising a seat flap that is positioned on the inner surface of the baby carrier in accordance with an embodiment of the present invention.

FIG. 13B is a ¾ view of an exemplary baby carrier comprising a seat flap that is positioned on the inner surface of the baby carrier in accordance with an embodiment of the present invention.

FIG. 13B is a ¾ view of an exemplary baby carrier 130 comprising a seat flap 131 that is positioned on the inner surface 137 of the baby carrier in accordance with an embodiment of the present invention. In the present embodiment, the seat flap 131 is positioned on the inner surface 137 of the baby carrier so that the baby carrier is positioned between the baby's body and the baby carrier. The top edge 132 of the seat flap 131 is attached to the inner surface of the upper region of the baby carrier with a zipper. In other embodiments, other suitable attachment means may be used. The bottom edge of the seat flap is attached to the baby carrier by sliding loops 135 onto the waistband 136 of the baby carrier. In other embodiments, other suitable attachment means may be used.

Having fully described at least one embodiment of the present invention, other equivalent or alternative methods of providing a supportive baby carrier that enables a user to carry a baby in multiple positions according to the present invention will be apparent to those skilled in the art. The invention has been described above by way of illustration, and the specific embodiments disclosed are not intended to limit the invention to the particular forms disclosed. For example, the particular implementation of the seat flap may vary depending upon the particular type of baby carrier used. The carriers described in the foregoing were directed to wearable implementations; however, similar techniques are to provide seat flaps for other types of baby carrying devices such as, but not limited to, high chairs, swings, strollers, activity seats, etc. Non-wearable implementations of the present invention are contemplated as within the scope of the present invention. The seat flap may also be incorporated into products that use a diaper-like structure to secure a person's pelvis such as, but not limited to a bungee or zip line harness to create more comfort and more natural seated position for the wearer. The invention is thus to cover all modifications, equivalents, and alternatives falling within the spirit and scope of the following claims.

Claim elements and steps herein have been numbered and/or lettered solely as an aid in readability and understanding. As such, the numbering and lettering in itself is not intended to and should not be taken to indicate the ordering of elements and/or steps in the claims.

What is claimed is:

1. An apparatus comprising:

a seat flap being configured to support a baby's buttocks and thighs in a sling like fashion, wherein said seat flap includes a bottom edge that is the edge closest to the ground when the baby sits upright; a top edge region, including a top edge that is the edge opposite said bottom edge at the center of said bottom edge; and opposing side edges, including a first side edge extending from a first corner of said top edge to a first corner of said bottom edge, and a second side edge extending from a second corner of said top edge to a second corner of said bottom edge;

a first attachment joining said top edge corners of said seat flap to opposing side portions of an upper portion of a baby carrier with said seat flap being positioned on an interior portion of a pouch of the baby carrier; the baby carrier being configured to carry the baby on a caregiver's body with the baby facing outward and with the baby facing inward, the baby carrier being configured to be operable to support the baby in an upright position; and a second attachment joining said bottom edge to a lower portion of the baby carrier, such that each of said side edges extends from a respective side portion of said upper portion of said pouch to said lower portion of said baby carrier, in which the baby sits upright, and the baby's legs are supported at an angle upward from a vertical axis of the baby, the baby's legs are primarily supported by said top edge with the baby facing outward, and the baby's legs are primarily supported by an elongate region of each side edge with the baby facing inward, and said seat flap comprises a height providing for the seat flap to wrap under the majority of the baby's thighs defining a seat in the outward-facing orientation.

2. The apparatus as recited in claim 1, in which said second attachment joins said bottom edge to a portion of the baby carrier proximate a waistband.

3. The apparatus as recited in claim 1, in which one or both of said first attachment and said second attachment removably joins to the baby carrier.

4. The apparatus as recited in claim 1, in which said second attachment joins to the baby carrier by a looping of the waistband.

5. The apparatus as recited in claim 1, in which one or more of said edges of said seat flap are padded for comfort of the baby.

6. The apparatus as recited in claim 1, in which said seat flap comprises soft durable fabric.

7. The apparatus as recited in claim 1, in which said seat flap is reversible for enabling different exterior looks.

8. An apparatus comprising:

a seat flap being configured to support a baby's buttocks and thighs in a sling like fashion, wherein said seat flap includes a bottom edge that is the edge closest to the ground when the baby sits upright; a top edge region, including a top edge that is the edge opposite said bottom edge at the center of said bottom edge; and opposing side edges, including a first side edge extending from a first corner of said top edge to a first corner of said bottom edge, and a second side edge extending from a second corner of said top edge and to a second corner of said bottom edge;

a first attachment joining said top edge corners of said seat flap to opposing side portions of an upper portion of a baby carrier with said seat flap being positioned on an interior portion of the baby carrier; the baby carrier being configured to carry the baby on the front of a caregiver's body with the baby facing outward, on the front of the caregiver's body with the baby facing inward, the baby carrier being configured to be operable to support the baby in an upright position; and a second attachment joining said bottom edge to a lower portion of the baby carrier proximate a waistband, such that each of said opposing side edges extends from a respective side portion of said upper portion of said baby carrier to said lower portion of said baby carrier, in which the baby sits upright, and the baby's legs are supported at an angle upward from a vertical axis of the baby, the baby's legs are primarily supported by said top edge with the baby facing outward, and the baby's legs are primarily supported by an elongate region of each side edge, suspended between a respective one of the top edge corners and said lower portion, with the baby facing inward, and said seat flap comprises a height providing for the seat flap to wrap under the majority of the baby's thighs defining a seat in the outward-facing orientation.

9. The apparatus as recited in claim 8, in which one or both of said first attachment and said second attachment removably joins to the baby carrier.

10. The apparatus as recited in claim 8, in which said second attachment joins to the baby carrier by a looping of the waistband.

11. The apparatus as recited in claim 8, in which one or more of said edges of said seat flap are padded for comfort of the baby.

12. The apparatus as recited in claim 8, in which said seat flap is reversible for enabling different exterior looks.

13. A baby carrier, comprising:

a main body including an upper portion and a lower portion, each of said portions including an upper end and lower end;

a crotch region between the lower end of said upper portion and said upper end of said lower portion of said main body, configured for receiving the crotch of a baby to be supported;

first and second connectors, each attached at respective first and second lateral side portions of said upper portion;

a first seat flap and a second seat flap, wherein said first and second seat flaps are separate and distinct from one another, and further wherein said first and second seat flaps are configured, in combination, for supporting a majority of a baby's buttocks and the baby's thighs in a sling like fashion, with said first seat flap extending laterally outward from one side of said main body and with said second seat flap extending laterally outward from an opposing side of said main body; wherein each of said seat flaps is disposed so as to be positioned under a respective one of the baby's thighs when supported in the carrier; and further wherein each of said seat flaps includes an inner side edge proximate to the vertical midline of said main body and attached to said main body generally along the length thereof, an outer side edge distal from said vertical midline, a top edge, and a bottom region;

an upper corner region of each of said seat flaps; wherein each upper corner region comprises a respective connector that connects to a respective one of said lateral side portions of said upper portion; and attachments for joining each of said bottom regions adjacent to said lower portion of said main body, such that the baby's legs are supported primarily by a respective one of said top edges with the baby facing outward, and said baby's legs are supported primarily by an elongate region of a respective one of said outer side edges, suspended between said upper portion and said lower portion, with said baby facing inward.

14. The carrier of claim 13, wherein said first and second connectors comprise affixed connectors.

15. The carrier of claim 13, wherein said first and second connectors comprise releasable connectors.

16. The carrier of claim 13, wherein each of said respective connectors of a respective upper corner region comprises an affixed connector.

17. The carrier of claim 13, wherein each of said respective connectors of a respective upper corner region comprises a releasable connector.

18. The carrier of claim 13, wherein each of said attachments is affixed.

19. The carrier of claim 13, wherein each of said attachments is releasable.

20. An apparatus removably employable on the exterior of a baby carrier, comprising:

a seat flap for supporting a majority of a baby's buttocks and the baby's thighs in a sling like fashion, wherein, said seat flap is configured to engage a baby carrier from an exterior of the baby carrier in order to be removably supported on the exterior of the baby carrier, the baby carrier is configured for supporting the baby in a substantially upright position on a user, the baby sits upright in an outward- or inward-facing orientation, and a change in orientation of the apparatus and the baby carrier is not required for a change in facing orientation of the baby between said outward- and inward-facing orientations;

the baby carrier comprising a baby holding portion comprising an upper portion and a lower portion, and a shoulder harnessing portion configured to harness the user's shoulders and secure the baby holding portion to the user's torso, and a respective junction region at opposing side portions of said upper portion where said shoulder harnessing portion meets said baby holding portion for removable attachment of respective upper regions of the seat flap;

said seat flap comprising a bottom edge region, including a bottom edge that is the edge closest to the ground when the baby sits upright; a top edge region, including a top edge that is the edge opposite said bottom edge at the center of said bottom edge; and opposing, side edge regions;

a first strap for removably joining a first corner of said top edge region at one of said junctions;

a second strap for removably joining a second corner of said top edge region at the other of said junctions on an opposing side portion of said upper portion of said baby holding portion;

wherein said first strap and said second strap each extend in a substantially radial direction away from a central region of the seat flap; and a waistband attached to the bottom edge region of said seat flap which removably encircles the user's lower torso and secures said seat flap against the exterior of the baby carrier at or around said lower portion of said baby holding portion, and the majority of the thighs and buttocks is supported by said seat flap, in either orientation, such that the baby's legs are supported primarily by said top edge in said outward-facing orientation and supported primarily by respective side edge regions in said inward-facing orientation, at an angle upward from a vertical axis through the baby within the baby carrier.

21. The apparatus of claim 20, further comprising first and second straps, wherein said respective upper regions of the seat flap connect to said junction regions through said first and second straps.

22. The apparatus of claim 21, wherein said straps are affixedly connected at one end at respective upper lateral regions of the seat flap, and releasably connectable at their other end at respective junction regions of the baby carrier.

23. An apparatus removably employable on the exterior of a baby carrier, comprising:

a seat flap for supporting a majority of a baby's buttocks and the baby's thighs in a sling like fashion, wherein, said seat flap is configured to engage a baby carrier from an exterior of the baby carrier in order to be removably supported on the exterior of the baby carrier, the baby carrier is configured for supporting the baby in a substantially upright position on a user, the baby sits upright in an outward- or inward-facing orientation, and a change in orientation of the apparatus and the baby carrier is not required for a change in facing orientation of the baby between said outward- and inward-facing orientations;

the baby carrier comprising a baby holding portion comprising an upper portion and a lower portion, and a shoulder harnessing portion configured to harness the user's shoulders and secure the baby holding portion to the user's torso, and a respective junction region at opposing side portions of said upper portion where said shoulder harnessing portion meets said baby holding portion for removable attachment of respective upper regions of the seat flap;

said seat flap comprising a bottom edge region, including a bottom edge that is the edge closest to the ground when the baby sits upright; a top edge region, including a top edge that is the edge opposite said bottom edge at the center of said bottom edge; and opposing side edges, including a first side edge extending from a first corner of said top edge to a first corner of said bottom edge, and a second side edge extending from a second corner of said top edge to a second corner of said bottom edge;

a first strap for removably joining a first corner of said top edge region at one of said junctions;

a second strap for removably joining a second corner of said top edge region at the other of said junctions on an opposing side portion of said upper portion of said baby holding portion;

and a waistband attached to the bottom edge region of said seat flap which removably encircles the user's lower torso and secures said seat flap against the exterior of the baby carrier at or around said lower portion of said baby holding portion, and the majority of the thighs and buttocks is supported by said seat flap, in either orientation, such that the baby's legs are supported primarily by said top edge in said outward-facing orientation and supported primarily by an elongate region along each side edge in said inward-facing orientation, at an angle upward from a vertical axis through the baby within the baby carrier.

24. An apparatus comprising:

means for supporting a majority of a baby's buttocks and the baby's thighs, wherein said supporting means includes a bottom edge that is the edge closest to the ground when the baby sits upright, a top edge that is the edge opposite said bottom edge at the center of said bottom edge, a first side edge extending from a first corner of said top edge to a first corner of said bottom edge, a second side edge extending from a second corner of said top edge to a second corner of said bottom edge, and a top edge region;

means for joining said top edge corners of said supporting means to opposing side portions of a pouch of a baby carrier at an upper portion of a baby carrier; and means for joining said supporting means to a lower portion of the baby carrier, such that each of said side edges extends from a respective side portion of said upper portion of said pouch to said lower portion of said baby carrier, wherein, the baby carrier is configured for supporting the baby in a substantially upright position on a user, said supporting means engages the baby carrier from an exterior of the baby carrier and is disposed on the exterior of the baby carrier, the baby sits upright in an outward- or inward-facing orientation and the majority of the baby's thighs and buttocks are supported by said supporting means, in either orientation, such that the supporting means wraps under the majority of the baby's thighs defining a seat in the outward-facing orientation, the baby's legs are supported primarily by said top edge in said outward-facing orientation and supported primarily by an elongate region along each side edge, suspended between a respective one of the top edge corners and said lower portion, in said inward-facing orientation, at an angle upward from a vertical axis through the baby within the baby carrier, and a change in orientation of the apparatus and the baby carrier is not required for a change in facing orientation of the baby between said outward- and inward-facing orientations.

25. An apparatus comprising:

a seat flap for supporting a majority of a baby's buttocks and the baby's thighs in a sling like fashion, said seat flap including a bottom edge that is the edge closest to the ground when the baby sits upright, a top edge that is the edge opposite said bottom edge at the center of said bottom edge, and further having a top edge region, a bottom edge region and opposing side edges, including a first side edge extending from a first corner of said top edge to a first corner of said bottom edge, a second side edge extending from a second corner of said top edge to a second corner of said bottom edge;

a first strap for joining a first corner of said top edge region to one side portion of an upper portion of a baby carrier;

a second strap for joining a second corner of said top edge region to the opposing side portion of said upper portion;

and attachments for joining said bottom edge region about a lower portion of the baby carrier, wherein, the baby carrier is configured for supporting the baby in a substantially upright position on a user, said seat flap engages the baby carrier from an exterior of the baby carrier and is disposed on the exterior of the baby carrier, the baby sits upright in an outward- or inward-facing orientation and the majority of the baby's thighs and buttocks are supported by said seat flap, in either orientation, such that the baby's legs are supported primarily by the top edge in said outward-facing orientation and supported primarily by an elongate region along each side edge in said inward-facing orientation, at an angle upward from a vertical axis through the baby within the baby carrier, and a change in orientation of the apparatus and the baby carrier is not required for a change in facing orientation of the baby between said outward- and inward-facing orientations.

26. A baby carrier system, comprising:

a pouch comprising an upper first end region and a lower narrowing region, adjacent to said first end region, which narrows to a smaller lateral width than the first end region; said narrowing region comprising an upper portion adjacent to said first end region and a bottom edge;

first and second elongate shoulder straps each comprising a first end and a second end connected and releasably connectable, respectively, at respective portions of the first end region of the pouch;

a seat flap comprising a bottom edge that is the edge closest to the ground when the baby sits upright wherein said bottom edge includes first and second corners, a top edge that is the edge opposite said bottom edge at the center of said bottom edge, wherein said top edge includes first and second corners and further including a bottom edge region, first and second side edges extending between said first corner of said top edge and said bottom edge and between said second corner of said top edge and said bottom edge, respectively, and a middle region between said top edge and said bottom edge;

a waistband connected at the bottom edge of the seat flap;

first and second connections comprising first and second seat-flap straps for joining said first and second corners of said top edge, respectively, adjacent to said first end region of said pouch, and a third connection for connecting said middle region, said bottom edge of said seat flap, or said waistband generally along the lateral width of said bottom edge of said narrowing region of said pouch, wherein said side edges of said seat flap at least in part define respective passages through which the baby's legs can pass out of said seat flap when the baby is in an inward-facing orientation, said smaller lateral width of said narrowing region of said pouch in combination with said top edge of said seat flap at least in part define respective passages through which the baby's legs can pass out of said baby carrier system when the baby is in an outward-facing orientation, and the seat flap wraps under the majority of the baby's thighs defining a seat in the outward-facing orientation; and, wherein, in operation, a baby sits upright in an outward- or inward-facing orientation and the baby's legs are supported by said seat flap, in either orientation, such that the baby's legs are supported primarily by the top edge in said outward-facing orientation and supported primarily by an elongate region along each side edge in said inward-facing orientation, at an angle upward from a vertical axis through the baby within the baby carrier system, and a change in orientation of the baby carrier system is not required fora change in facing orientation of the baby between said outward- and inward-facing orientations.

* * * * *